US006389144B1

(12) United States Patent
Lee

(10) Patent No.: US 6,389,144 B1
(45) **Date of Patent: *May 14, 2002**

(54) SOUND FIELD EQUALIZING APPARATUS FOR SPEAKER SYSTEM

(75) Inventor: Deog Jin Lee, Kyungsangbook-Do (KR)

(73) Assignee: LG Electronics Inc., Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/909,082

(22) Filed: Aug. 14, 1997

(30) Foreign Application Priority Data

Jul. 29, 1997 (KR) ..... 97/35710

(51) Int. Cl.[7] ..... H04R 25/00
(52) U.S. Cl. ..... 381/340; 381/341; 381/337
(58) Field of Search ..... 181/152, 159, 181/175, 178, 184, 187, 195; 381/159, 192, 337, 339, 350, 351, 352, 353, 357, 160

(56) References Cited

U.S. PATENT DOCUMENTS

| | | | | | |
|---|---|---|---|---|---|
| 3,136,382 | A | * | 6/1964 | Thatler | 381/156 |
| 4,157,741 | A | * | 6/1979 | Goldwater | 381/343 |
| 4,485,275 | A | * | 11/1984 | Lahti | 381/341 |
| 4,628,155 | A | * | 12/1986 | Robineau | 381/343 |
| 4,776,428 | A | * | 10/1988 | Belisle | 381/343 |
| 5,526,456 | A | * | 6/1996 | Heinz | 381/156 |

FOREIGN PATENT DOCUMENTS

| | | | | |
|---|---|---|---|---|
| DE | 2822680 | * | 12/1978 | 381/FOR 143 |
| JP | 61-89798 | * | 5/1986 | 381/FOR 143 |

* cited by examiner

*Primary Examiner*—Sinh Tran
(74) *Attorney, Agent, or Firm*—Birch, Stewart, Kolasch & Birch, LLP

(57) ABSTRACT

A sound field equalizing apparatus for a speaker system which is capable of widening a region in which it is possible to effectively hear a sound field. The apparatus includes a sound field equalizing member disposed in a dispersing hole formed in a cabinet of a speaker for separating a sound dispersed from the speaker into a forwardly dispersed sound which is dispersed in a central direction and a laterally dispersing sound which is dispersed in a peripheral direction of the forwardly dispersing sound.

20 Claims, 6 Drawing Sheets

SOUND FIELD EQUALIZING APPARATUS FOR SPEAKER SYSTEM

BACKGROUND OF THE INVENTION

1. Field of the Invention

The present invention relates to a sound field equalizing apparatus for a speaker system, and in particular to an improved sound field equalizing apparatus for the speaker system which is capable of uniformly dispersing sounds generated by a speaker to all corners of a room in which the speaker system is installed.

2. Description of the Conventional Art

FIG. 1 illustrates a conventional speaker system of a television set, and FIG. 2 illustrates the portion "A" of FIG. 1. As shown therein, a plurality of sound dispersing holes 3 are formed in a front panel 2 of a cabinet 1. A speaker affixing rib 4 is formed on an inner surface of the front panel 2, so that the speaker 5 is affixed to the speaker affixing rib 4. In the drawing, reference numeral 6 denotes a Braun tube.

Sounds from the speaker 5 are dispersed through the sound dispersing holes 3.

At this time, the sounds generated by the speaker 5 and dispersed through the sound dispersing holes 3 are forwardly dispersed within a predetermined angle range.

However, in the conventional speaker affixing structure, when affixing the speaker 5 to the speaker affixing rib 4, since a vibration plate (not shown) of the speaker 5 is formed deeper than the front panel 2 of the cabinet 1 in which the sound dispersing holes 3 are formed, a sound dispersing effect is varied, thus causing an inaccurate and uncomfortable sound listening effect.

Namely, the lower a frequency band, the less variation of a width of the frequency in the characteristics of the sound. As the frequency band is increased to a high-pitched sound, the frequency band is delicately varied in accordance with the direction of the frequency band.

Therefore, when adapting the conventional speaker affixing structure in the television set, in the case when a television viewer or listener sits in front of the television set within an effective angle range of about 30°, the sounds are uniformly dispersed, so that the television viewer can listen to the uniform sounds from the speaker. However, when the viewer is within effective angle of 45°, the television viewer or listener cannot hear uniform sounds from the speaker. Namely, the high-pitched sound effect is decreased in the range of the 45°.

The above-described high-pitched sound reducing phenomenon causes a reduction of a stereo sound, whereby a mono sound is produced and a dynamic sound is decreased.

In addition, when the television viewer or listener sits in front of the television set and listens to the sounds from the speakers of the television set, the high-pitched sound is not reduced. However, an uneven and non-uniform sounds are generated due to the characteristic degradation of the dispersing sounds and the reduction of the high-pitched sounds within the range of the 45° because the amount of the sounds from the speaker are diffracted and the sounds laterally transferred thereto are decreased.

At this time, the listener may hear uneven sounds due to the narrow width of the sound pitch. Therefore, in the conventional speaker system, the directional and spacial sounds are decreased.

SUMMARY OF THE INVENTION

Accordingly, it is an object of the present invention to provide a sound field equalizing apparatus for a speaker system which overcomes the aforementioned problems encountered in the conventional art.

It is another object of the present invention to provide the sound field equalizing apparatus for the speaker system which is capable of uniformly dispersing sounds to all corners of a room.

It is another object of the present invention to provide the sound field equalizing apparatus for the speaker system which is capable of significantly improving a sound field by using a sound pressure of a laterally diffracted sound even when a user listens in front of a speaker system and maintaining a balance between a forwardly dispersing sound and a laterally dispersing sound.

It is another object of the present invention to provide the sound field equalizing apparatus for the speaker system which is capable of widening an effective region in which it is possible to effectively enjoy the sound field.

To achieve the above objects, there is provided the sound field equalizing apparatus for the speaker system according to a first embodiment of the present invention which includes a sound field equalizing member disposed in a dispersing hole formed in a cabinet of a speaker for separating sounds generated by the speaker into a centrally forwardly dispersing sounds and a laterally dispersing sounds.

To achieve the above objects, there is provided the sound field equalizing apparatus for the speaker system according to a second embodiment of the present invention which includes a sound field equalizing member disposed in a dispersing hole formed in a cabinet of a speaker for blocking a forwardly dispersing sounds among the sounds generated by the speaker and separating and laterally dispersing the sounds.

Additional advantages, objects and features of the invention will become more apparent from the description which follows.

BRIEF DESCRIPTION OF THE DRAWINGS

The present invention will become better understood from the detailed description given hereinbelow and the accompanying drawings which are given by way of illustration only, and thus are not limitative of the present invention, and wherein:

FIGS. 3 and 4 are views illustrating a sound field equalizing apparatus according to the present invention, of which:

FIG. 3 is a horizontal cross-sectional view illustrating the sound field equalizing apparatus according to the present invention; and FIG. 4 is a perspective view illustrating a speaker sound dispersing member of the sound field equalizing apparatus according to the present invention;

DETAILED DESCRIPTION OF THE INVENTION

The sound field equalizing apparatus for a speaker system according to the present invention will now be explained with reference to the accompanying drawings.

Figure 1:
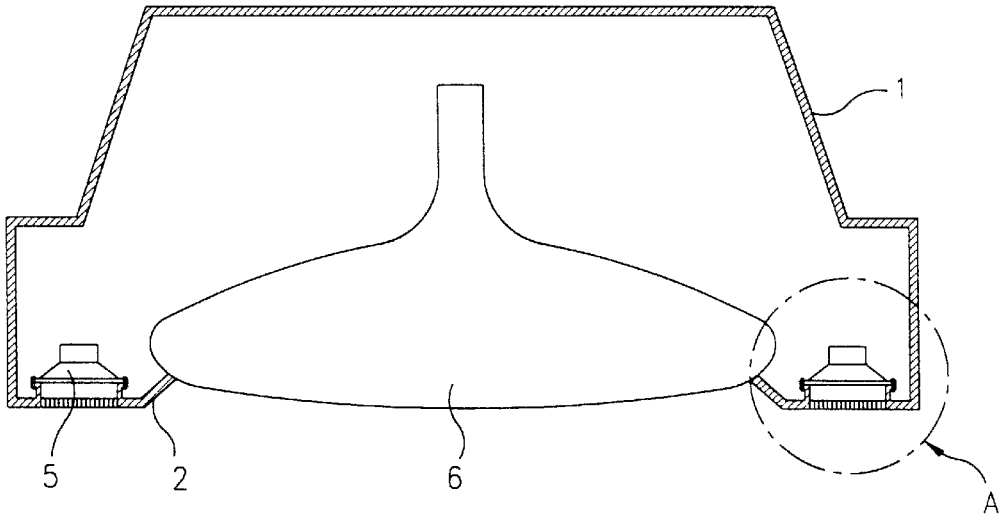
FIG. 1 CONVENTIONAL ART
FIG. 1 is a horizontal cross-sectional view illustrating a conventional speaker system of a television set.
Figure 2:
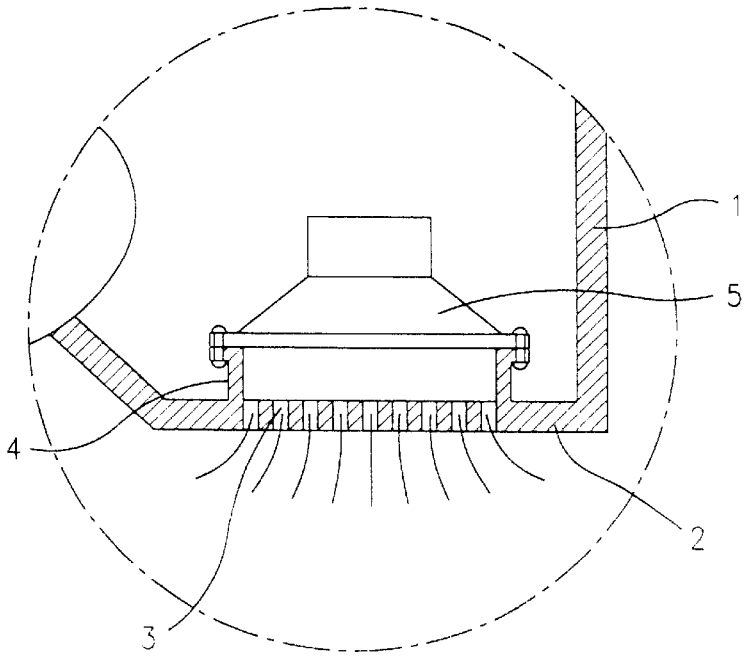
FIG. 2 CONVENTIONAL ART
FIG. 2 is an enlarged view illustrating the portion "A" of FIG. 1.
Figure 3:
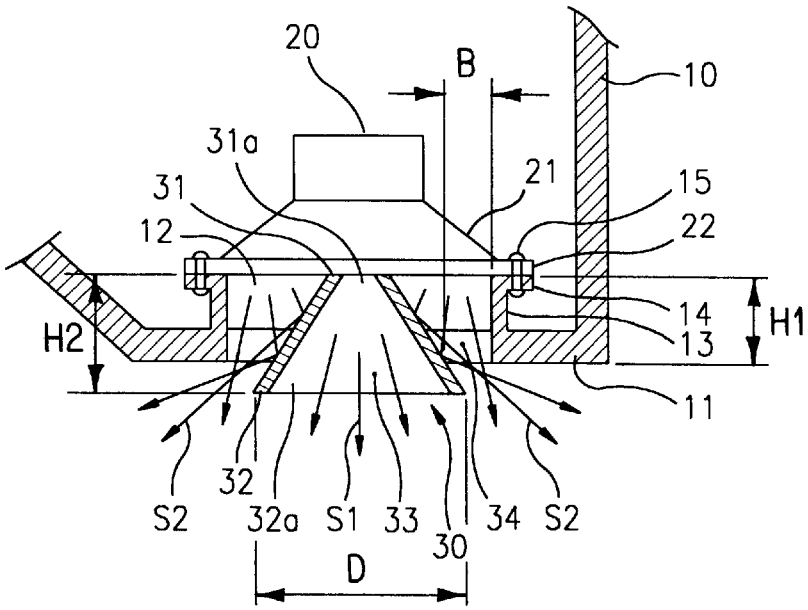

First, as shown in FIG. 3, in the sound field equalizing apparatus for the speaker system according to the present invention, sound dispersing holes 12 are formed in a front panel 11 of a cabinet 10, and a speaker 20 is installed inside of the front panel 11. At this time, the sound dispersing holes 12 are circularly formed in the front panel 11. The diameter of each of the sound dispersing hole 12 is similar to the diameter of a vibration plate (not shown).

A speaker affixing rib 13 is formed on an inner surface of the front panel 11 for affixing the speaker 20 thereto. An outwardly bent portion 14 is formed around the upper edge of the affixing rib 13, and an affixing screw 15 passing through a flange portion 22 formed on a rim portion of a speaker cone 21 is engaged to the outwardly bent portion 14, so to affix the speaker 20 to the front panel 11.

A sound field equalizing member is installed in the sound dispersing hole 12 for separating sound dispersed from the speaker 20 into a forwardly dispersed sound S1 and a laterally dispersed sound S2.

The sound field equalizing member includes a speaker sound separating and dispersing member 30 having a narrow inner portion 31 affixed to the speaker 20 and an outer portion 32 which is exposed to the front surface.

Here, the speaker sound separating and dispersing member 30 may be formed integrally, i.e., flushed, with the front panel 11 or may be formed separately from the front panel 11. A plurality of connection ribs (not shown) are formed for connecting the front panel 11 and the speaker sound dispersing and dispersing member 30.

In the speaker's sound separating and dispersing member 30, a forwardly dispersed sound path 33 is defined by the inner circumferential surfaces formed between a forwardly dispersing sound inlet 31*a* formed in the upper end portion thereon and a forwardly dispersing sound outlet 32*a* formed in the lower portion 32, and a laterally dispersing sound path 34 is defined between the outer circumferential surface thereof and the inner circumferential surfaces of the sound dispersing hole 12.

The diameter D of a center portion of the sound outlet 32*a* of the forwardly dispersing sound path 33 is formed to be larger than the width B of the laterally dispersing sound path 34.

The lower portion 32 of the speaker sound separating and dispersing member 30 is forwardly protruded more than the front surface of the front plate 11.

The operation of the sound field equalizing apparatus for a speaker system according to the present invention will now be explained.

The sounds dispersed from the speaker 20, as shown in FIG. 3, are separated into the forwardly dispersing sounds S1 which are dispersed into the forwardly dispersing sound outlet 32*a* through the forwardly dispersing sound inlet 31*a* and the forwardly dispersing sound path 33, and the dispersing sounds S2 dispersed through the laterally dispersed sound path 34.

The forwardly dispersed sounds S1 are transferred into the forwardly dispersing sound inlet 31*a* formed in the upper portion 31 of the speaker sound separating and dispersing member 30 and dispersed from the forwardly dispersing sound outlet 32*a* formed in the lower portion 32 through the forwardly dispersing sound path 33. These dispersing sounds have characteristics which are similar to those of the forwardly dispersing sounds in the conventional art and forms a sound field in front of the speaker.

In addition, a high-pitched sound component is mainly generated from the center portion of the speaker 20. Since the forwardly dispersing sound inlet 31*a* of the forwardly dispersing sound path 33 is disposed at the center portion of the speaker 20, the sound pressure of the high-pitched sound is prevented from being deteriorated in the downward direction by forwardly dispersing the high-pitched sound components, compared to that of the conventional art.

The dispersing sounds S2 serve to guide the dispersing sounds laterally from the speaker 20 and to form an expanded sound field. The thusly dispersing sounds are dispersed into the entire surrounding area in the upper, lower, leftward and rightward directions in accordance with the shape of the speaker sound separating and dispersing member 30. Here, the forwardly dispersing sounds S1 are diffracted laterally from the position of the listener and then are combined with the dispersing sounds S2, thus maintaining a desired balance of a sound pressure.

Therefore, even when a listener sits within a range of an angle of more than 45°, the listener feels the sound pressure and a sound field. In addition, it is possible to obtain a wider sound field because the dispersing sounds due to the diffraction of the forwardly dispersing sounds S1 and the dispersing sounds S2 which disperses along the laterally dispersing sound path 34 are combined.

Figure 5:
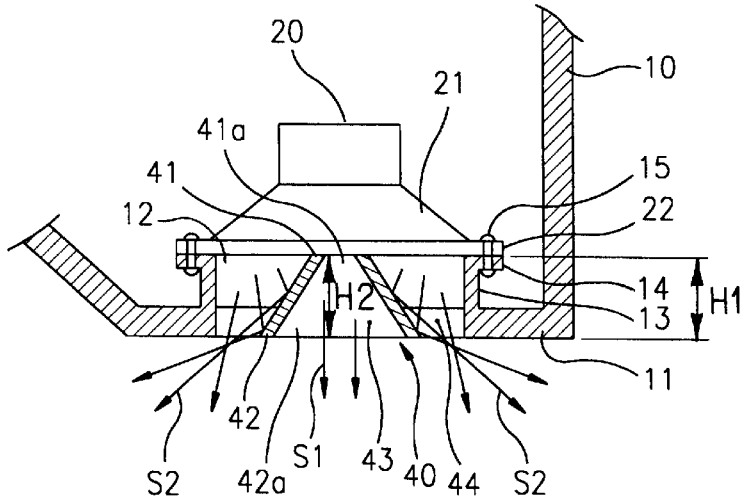
FIG. 5 is a horizontal cross-sectional view illustrating a sound field equalizing apparatus according to another embodiment of the present invention.

FIG. 5 illustrates a sound equalizing apparatus according to another embodiment of the present invention. As shown therein, a speaker sound separating and dispersing member 40 of a sound field equalizing member is formed in a conical shape, and a lower portion 42 is extended to a the front panel 11 and is integrally formed with the front panel 11.

Figure 4:
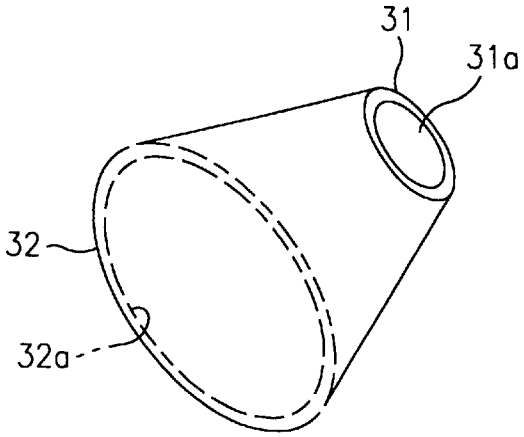

In this embodiment of the present invention, a length of the forwardly dispersing sound path 33 is made shorter compared to the embodiment of FIGS. 3 and 4, and a forwardly dispersing sound S1 is emphasized as compared to the dispersing sound S2. Therefore, the apparatus is formed to effectively disperse sounds by using a small angle.

Namely, the dispersing effects of the dispersing sounds S2 through a laterally dispersing sound path 34 are increased compared to the forwardly dispersing sounds S1, thus widening the sound field.

In FIG. 5, reference numeral 41 denotes an upper end, 41*a* denotes a forwardly dispersing sound inlet, 42*a* denotes a forwardly dispersing sound outlet, 43 denotes a forwardly dispersing sound path, and 44 denotes a laterally dispersing sound path. Since the structure and operations of the above-described elements are the same as the previous embodiment of the present invention, the detailed descriptions thereof will be omitted.

Figure 6:
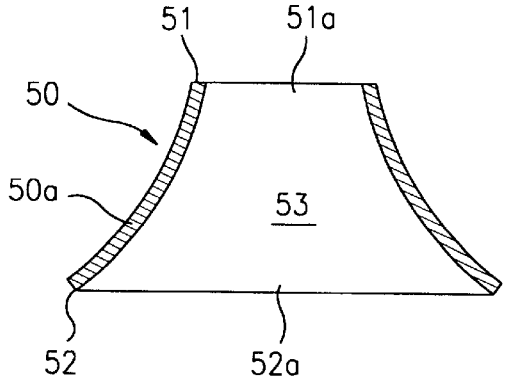
FIG. 6 is a cross-sectional view illustrating a sound field equalizing apparatus according to another embodiment of the present invention.

FIG. 6 illustrates a sound field equalizing apparatus according to another embodiment of the present invention.

As shown therein, in this embodiment of the present invention, a wall 50*a* of a speaker sound separating and dispersing member 50 is outwardly and downwardly curved toward a forwardly dispersing sound outlet 52*a* of a lower portion 52, i.e., concaved, thus increasing a sound field effect by dispersing and amplifying the forwardly dispersed sounds. The sounds are dispersed at an angle of 60° from the front side of the speaker. In particular, the sounds are effectively dispersed to the corners which are formed beyond an angle of more than 60°, thus obtaining a desired balance of the sounds.

In FIG. 6, reference numeral 53 denotes a forwardly dispersing sound path.

Figure 7:
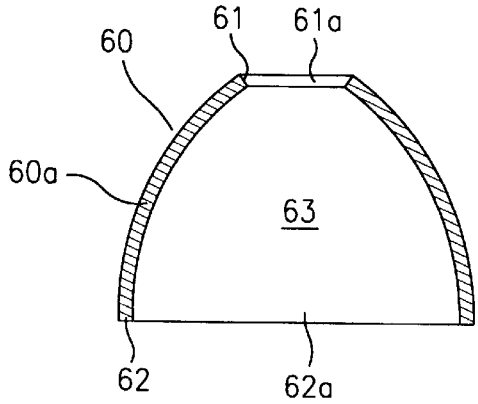
FIG. 7 is a cross-sectional view illustrating a sound field equalizing apparatus according to still another embodiment of the present invention.

FIG. 7 illustrates a sound field equalizing apparatus according to another embodiment of the present invention. A wall 60*a* of a speaker sound separating and dispersing member 60 of the sound field equalizing member is inwardly and downwardly curved toward a forwardly dispersing sound outlet 52*a* of a lower portion 52, i.e., convexed, thus increasing a sound field effect by dispersing and amplifying the forwardly dispersing sounds. Therefore, the sounds are dispersed at an angle of 60° from the front portion of the speaker. In particular, the sounds are effectively dispersed to the corners which are formed beyond an angle of more than 60°, thus obtaining a desired balance of the sounds.

Namely, the apparatus is formed to disperse sounds within an angle range of 30° to 60° from the front portion of the speaker, thus obtaining a desired balance of the sounds even at corners formed within a range of 30° to 60°.

In FIG. 7, reference numeral 63 denotes a forwardly dispersing sound path.

Figure 8:
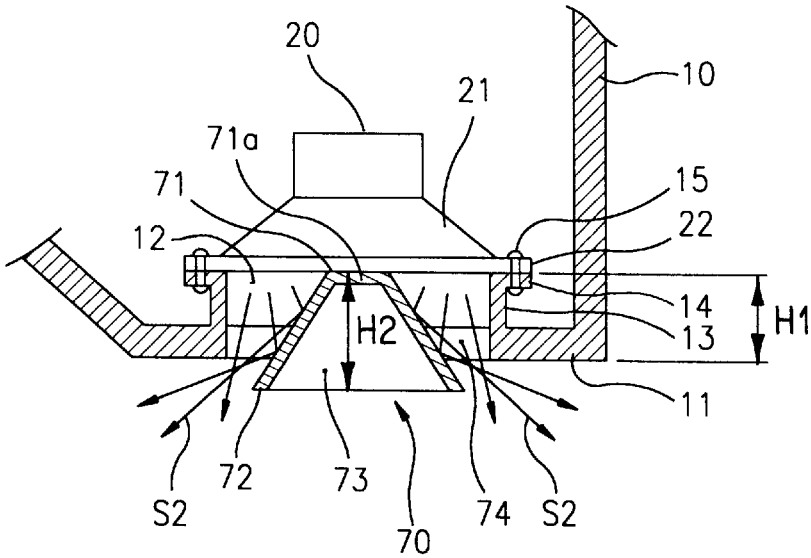
FIG. 8 is a cross-sectional view illustrating a sound field equalizing apparatus according to still another embodiment of the present invention.

FIG. 8 illustrates a sound field equalizing apparatus according to another embodiment of the present invention. As shown therein, a space 73 is formed within a speaker sound separating and dispersing member 70, and a forwardly dispersing sound blocking member 71*a* is formed in an upper portion 71. In addition, a laterally dispersing sound path 74 is formed between the inner circumferential surfaces of the dispersing hole 12, so that a forwardly dispersing sounds which have a high-pitched sound component are blocked and converted into medium level sounds. The forwardly dispersing sound blocking member 71*a* is formed in a flat inner end.

In addition, it is possible to disperse the medium level sounds by providing a squirter having a small diameter and being capable of generating a high-pitched sound.

In this embodiment, the description of the constructions, which are the same as the previous embodiments of the present invention, will be omitted.

Figure 9:
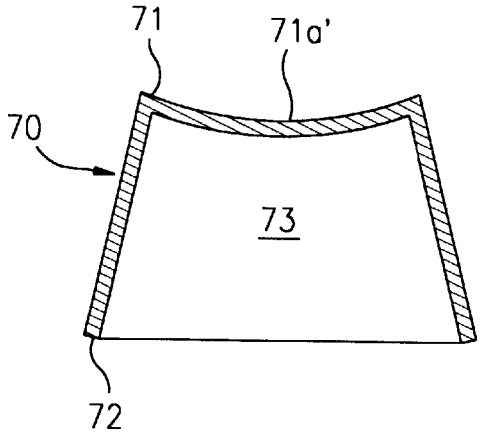
FIG. 9 is a cross-sectional view illustrating a sound field equalizing apparatus according to still another embodiment of the present invention.

FIG. 9 illustrates a sound field equalizing apparatus according to get another embodiment of the present invention. As shown therein, a forwardly dispersing sound blocking portion 71*a* is formed in an upper portion 71 of a speaker sound separating and dispersing member 70 curved away from the speaker.

Since the elements of this embodiment of the present invention is the same as the previous embodiment except for the above-described construction, the detailed descriptions thereof will be omitted.

Figure 10:
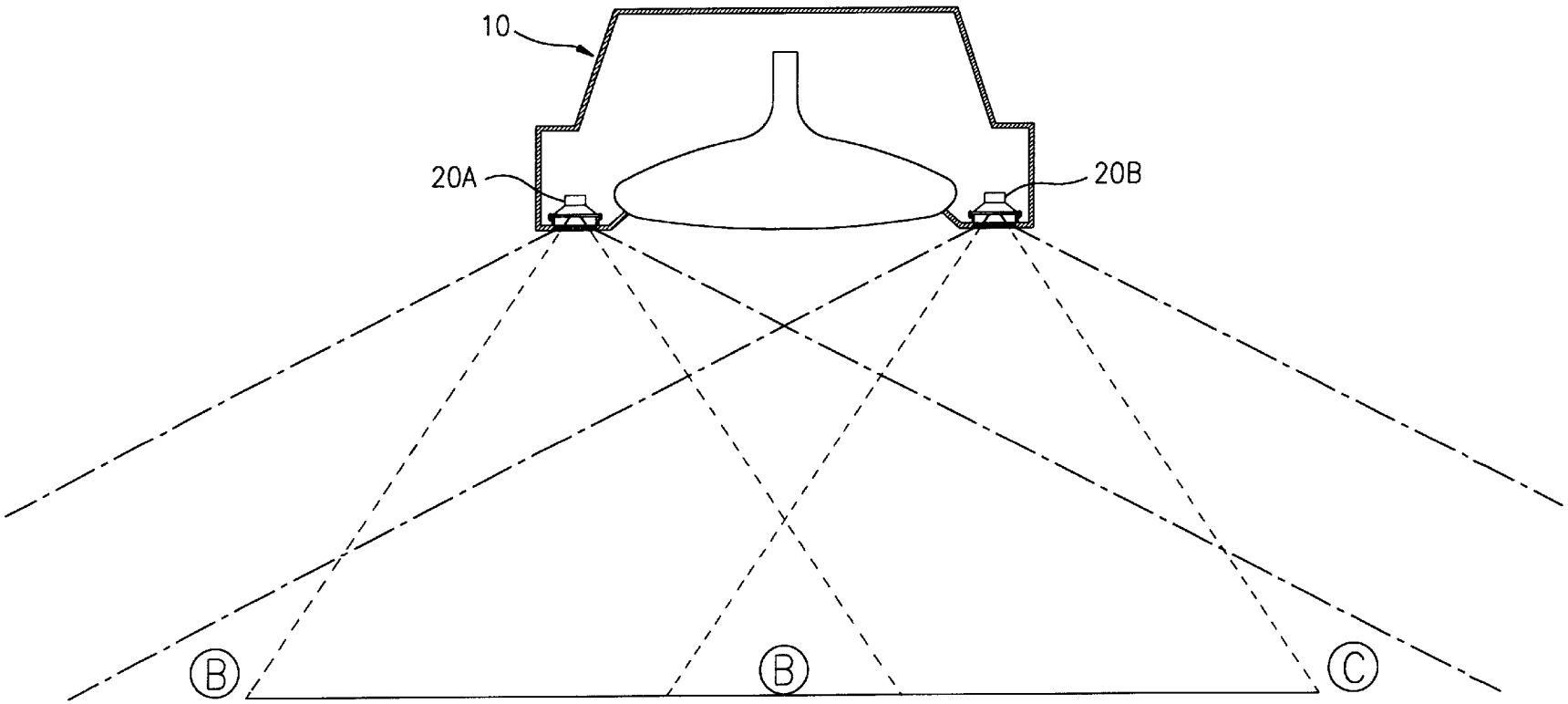
FIG. 10 is a view illustrating a sound field effect region according to the present invention compared to the conventional art.
Figure 11:
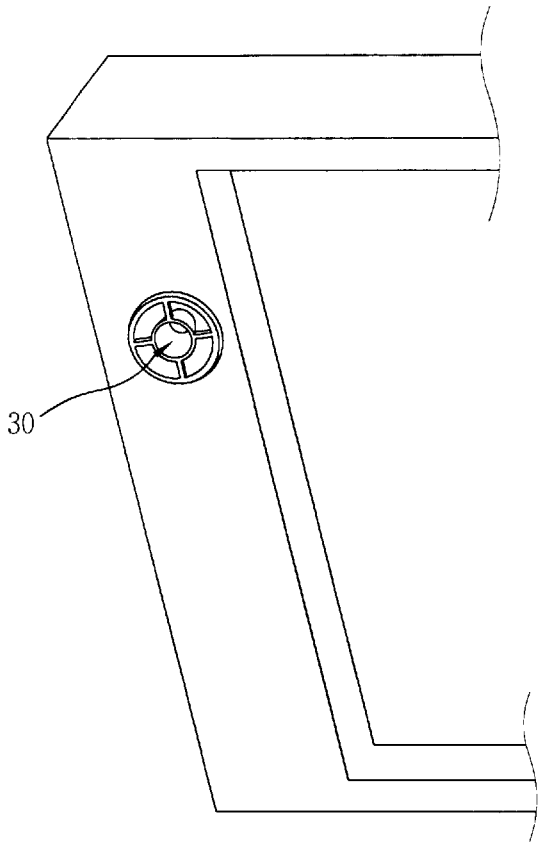
FIGS. 11 and 12 are perspective views of the sound field equalizing apparatus and the placement of the sound field equalizing apparatus on the front panel of a television.
Figure 12:
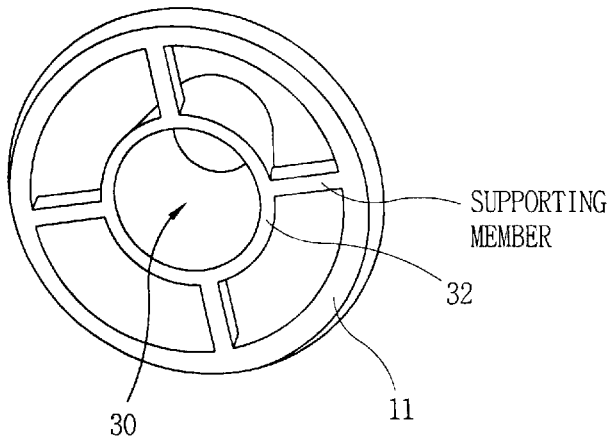

FIG. 10 illustrates a sound field effect region according to the present invention compared to the conventional art. As shown therein, a region indicated by a broken line denotes a sound field effect region of the conventional speaker, and a region indicated by a dash-dot line denotes a sound effect region of the speaker according to the present invention. In the conventional art, a listener A who sits in front of the television set can hear a stereo sound field through speakers 20A and 20B. However, another listener who sits inside the sound field effect region hears a mono type sound field because the sound fields are reflected by walls, and the sounds are decreased due to the dispersing effect. Therefore, the listener hears the sound field as if the listener is sitting within the sound dispersing region of only one speaker, thus hearing a decreased sound field effect. In the present invention, it is possible to obtain stereo sound dispersing effects within a wider angle range. Therefore, listeners B and C who sit outside the range of the conventional sound field of the television set can still enjoy the stereo sound effect, like the listener A who sits in front of the television set with the present invention.

As described above, the sound field equalizing apparatus for the speaker system according to the present invention is directed to separating speaker sounds into the forwardly dispersing sound, the dispersing sound, and effectively and widely dispersing the sounds, thus increasing the sound field effect at a greater area. In addition, when a listener hears the sounds in front of the television set, the sound pressure generated by the speaker which is laterally diffracted is supplemented, thus maintaining a balance between the sounds in front of the television set and the sounds laterally dispersed from the speakers and thus increasing the sound field effects. Furthermore, it is possible to effectively disperse the medium level sounds by blocking the forwardly dispersing sounds having high-pitched sound components.

Although the preferred embodiment of the present invention has been disclosed for illustrative purposes, those skilled in the art will appreciate that various modifications, additions and substitutions are possible, without departing from the scope and spirit of the invention as recited in the accompanying claims.

What is claimed is:

1. An apparatus for a speaker system, comprising:

a housing for storing a speaker therein, the housing including a cabinet having a front panel, and a dispersing hole formed in the front panel of the cabinet; and a sound horn disposed in the dispersing hole such that no other sound horn encloses the sound horn, wherein an inlet diameter of the sound horn is less than a diameter of a diaphragm of the speaker and wherein sounds from the diaphragm travel within an interior surface and also to an exterior surface of the sound horn, and wherein said sound horn defines a forwardly dispersing sound path through the sound horn; and wherein a laterally dispersing sound path is defined between an outer circumferential surface of the sound horn and an inner circumferential surface of said dispersing hole formed in said front panel of the cabinet, whereby sound exits said speaker housing both from said sound horn along said forward dispersing sound path and along said laterally dispersing sound path through said dispersing hole.

2. The apparatus of claim 1, wherein said sound horn includes:

a forwardly dispersing sound inlet formed in an upper portion of the sound horn and disposed in a center portion of the diaphragm; and a forwardly dispersing sound outlet formed in a lower portion of the sound horn.

3. The apparatus of claim 2, wherein the sound horn includes a wall which is outwardly curved from the forwardly dispersing sound inlet to the forwardly dispersing sound outlet.

4. The apparatus of claim 2, wherein the sound horn includes a wall which is inwardly curved from the forwardly dispersing sound inlet to the forwardly dispersing sound outlet.

5. The apparatus of claim 2, wherein the forwardly dispersing sound path is defined by an inner surface of the sound horn between the forwardly dispersing sound inlet and the forwardly dispersing sound outlet.

6. The apparatus of claim 1, wherein an outer end portion of the sound horn is outwardly protruded beyond the outer front surface of the front panel of the housing.

7. The apparatus of claim 1, wherein an outer end portion of the sound horn is flush with an outer front surface of the front panel of the housing.

8. The apparatus of claim 1, further comprising:

a blocking member formed at one end portion of the sound horn for blocking a forwardly dispersing sound generated by the diaphragm and for separating laterally dispersing sounds.

9. The apparatus of claim 8, wherein said blocking member has a flat inner end.

10. The apparatus of claim 8, wherein an inner end of said blocking member is inwardly curved away from the speaker.

11. The apparatus of claim 1, wherein the sound horn has a substantially conical shape.

12. The apparatus of claim 1, wherein the sound horn has a first end portion placed directly against a center portion of the speaker, and a second end portion protruding from the front panel of the housing.

13. The apparatus of claim 12, wherein the diameter of the second end portion of the sound horn is greater than the diameter of the first end portion of the sound horn.

14. The apparatus of claim 1, wherein an affixing member is disposed substantially perpendicular to the front panel of the housing.

15. The apparatus of claim 14, wherein the speaker is mounted to the affixing member using a fastener.

16. The apparatus of claim 1, wherein the forwardly and laterally dispersing sound paths generate high frequency sounds.

17. An apparatus for a speaker system, comprising:

a housing for storing a speaker therein, the housing including a panel portion and a dispersing hole formed in said panel portion; and a sound horn disposed in said dispersing hole such that no other sound horn encloses the sound horn and sounds from a diaphragm of said speaker travel within an interior surface and also to an exterior surface of the sound horn, and an inlet diameter of said sound horn being less than a diameter of the diaphragm of the speaker, and wherein said sound horn defines a forwardly dispersing sound path through the sound horn; and wherein a laterally dispersing sound path is defined between an outer circumferential surface of the sound horn and an inner circumferential surface of said dispersing hole formed in said panel portion, whereby sound exits said speaker housing both from said sound horn along said forward dispersing sound path and along said laterally dispersing sound path through said dispersing hole in said panel portion.

18. The apparatus of claim 17, wherein the panel portion is a front panel located in a front portion of the housing.

19. The apparatus of claim 17, wherein the sound horn protrudes more than an outer front surface of the panel portion.

20. The apparatus of claim 17, further comprising an affixing member for mounting the speaker thereto, formed on an inner surface of the panel portion, a height of said affixing member being equal to or greater than the height of the sound horn.

* * * * *